US009114942B1

(12) United States Patent
Fahilga et al.

(10) Patent No.: US 9,114,942 B1
(45) Date of Patent: Aug. 25, 2015

(54) AUTOMATIC DOCUMENT ALIGNMENT

(71) Applicants: Ronald Fahilga, Rancho Cucamonga, CA (US); Glenn Embury, Fontana, CA (US); Christian Chu, Corona, CA (US)

(72) Inventors: Ronald Fahilga, Rancho Cucamonga, CA (US); Glenn Embury, Fontana, CA (US); Christian Chu, Corona, CA (US)

(73) Assignee: Digital Check Corporation, Northbrook, IL (US)

( * ) Notice: Subject to any disclaimer, the term of this patent is extended or adjusted under 35 U.S.C. 154(b) by 0 days.

(21) Appl. No.: 14/318,335

(22) Filed: Jun. 27, 2014

(51) Int. Cl.

| | |
|---|---|
| ***B65H 9/00*** | (2006.01) |
| ***B65H 7/02*** | (2006.01) |
| ***B65H 5/06*** | (2006.01) |
| ***B65H 9/10*** | (2006.01) |
| ***B65H 9/16*** | (2006.01) |

(52) U.S. Cl.
CPC ..... *B65H 9/002* (2013.01); *B65H 5/06* (2013.01); *B65H 7/02* (2013.01); *B65H 9/106* (2013.01); *B65H 9/166* (2013.01)

(58) Field of Classification Search
CPC ..... B65H 9/16; B65H 9/166; B65H 2404/72; B65H 2404/732; B65H 5/06; B65H 7/00; B65H 7/20; B65H 9/00; B65H 9/004; B65H 9/04; B65H 2404/1112; B65H 2404/1113; B65H 2301/321; B65H 2301/331; B65H 9/106; B65H 2404/1141
USPC ..... 271/250, 251, 252
See application file for complete search history.

(56) References Cited

U.S. PATENT DOCUMENTS

| | | | | |
|---|---|---|---|---|
| 4,438,918 | A * | 3/1984 | Ito et al. | 271/251 |
| 4,505,471 | A * | 3/1985 | Stockburger et al. | 271/251 |
| 5,577,719 | A * | 11/1996 | Nicoll | 271/227 |
| 6,042,110 | A * | 3/2000 | Inage | 271/251 |
| 7,651,083 | B2 | 1/2010 | Embury et al. | |
| 2008/0073835 | A1 | 3/2008 | Embury et al. | |
| 2009/0206152 | A1 | 8/2009 | Embury et al. | |

* cited by examiner

*Primary Examiner* — David H Bollinger
(74) *Attorney, Agent, or Firm* — Fish & Richardson P.C.

(57) ABSTRACT

The present disclosure involves systems and methods for performing automatic document alignment. One example system includes a document staging area including an alignment surface extending in a document feed direction; an alignment roller supported to rotate about an axis and intermittently contact a document in the document staging area while rotating to move the document to abut the alignment surface; and a feed roller support to rotate in the document feed direction to feed the document in the document feed direction after the alignment roller has rotated to move the document to abut the alignment surface.

18 Claims, 11 Drawing Sheets

AUTOMATIC DOCUMENT ALIGNMENT

BACKGROUND

The present disclosure involves systems and methods for performing automatic document alignment.

In document processing systems, multiple documents may be loaded into the system at once, such as by loading the documents into an input location. The documents may then be moved one-by-one from the input location to a second location where document processing (e.g., scanning) is performed. This document movement may be performed by feeding mechanisms that move each document from the input location to the second location.

SUMMARY

The present disclosure involves systems and methods for performing automatic document alignment. In one general aspect, an example system includes a document staging area including an alignment surface extending in a document feed direction; an alignment roller supported to rotate about an axis and intermittently contact a document in the document staging area while rotating to move the document to abut the alignment surface; and a feed roller support to rotate in the document feed direction to feed the document in the document feed direction after the alignment roller has rotated to move the document to abut the alignment surface.

In another general aspect, an example method includes for each of a plurality of documents in a document staging area, the document staging area including an alignment surface extending in a document feed direction: rotating an alignment roller to intermittently contact a document in the document staging area to move the document to abut the alignment surface; and rotating a feed roller in the document feed direction to feed the document in the document feed direction upon the alignment roller completing a rotation.

The details of these and other aspects and implementations of the present disclosure are set forth in the accompanying drawings and the description below. Other features, objects, and advantages of the disclosure will be apparent from the description and drawings, and from the claims.

DETAILED DESCRIPTION

Figure 1:
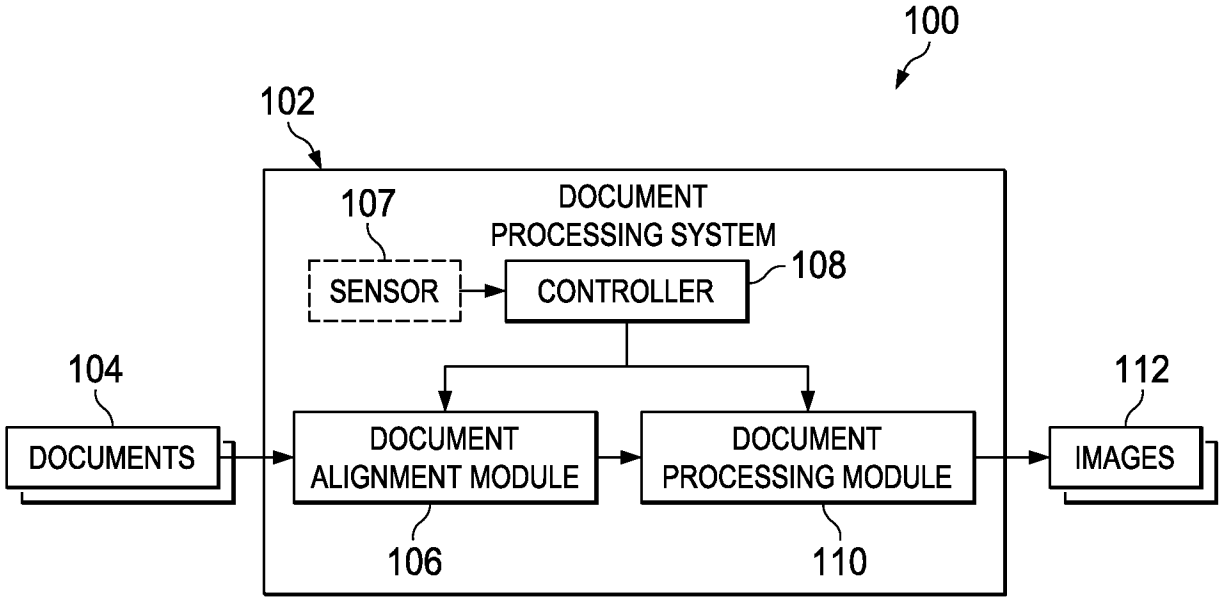
FIG. 1 is a block diagram illustrating an example system for performing automatic document alignment.

The present disclosure involves systems and methods for performing automatic document alignment.

Generally, document processing systems are designed to perform processing tasks on multiple documents. Each document may be fed individually from an input location to another location for processing. In some cases, it may be desirable to process documents of different lengths and widths at once. For example, in check processing, checks and other payment instruments may not be a standard size, and therefore each document may have a different length and width. In some cases, a user may be required to align or "jog" documents prior to feeding to ensure that the leading and/or bottom edges are aligned. If such jogging is not done or done improperly, document skew may result, which may lead to double feed errors (i.e., two or more documents being fed at once), jam errors involving documents being lodged in the feeding mechanism, misread of magnetic account information in the case of checks or other financial documents, or other processing errors.

Accordingly, the present disclosure describes techniques configured to reduce or eliminate jogging requirements in document processing systems. Although the present disclosure generally describes vertical alignment of documents, the techniques described herein may be applied to aligning documents in other ways (e.g. horizontally). In one example implementation, document alignment is performed by a set of alignment rollers on the both sides of a feed roller. The feed roller is operable to feed documents individually in a feed direction into a processing location in the document processing system. Before each document is fed by the feed roller, the alignment rollers rotate to contact the document and force a bottom edge of the document to contact an alignment surface.

One example method for performing document alignment includes, for each of a plurality of documents in a document staging area including an alignment surface extending in a document feed direction, rotating an alignment roller to intermittently contact a document in the document staging area to move the document to abut the alignment surface. A feed roller is then rotated in the document feed direction to feed the document in the document feed direction upon the alignment roller completing a rotation.

Implementations according to the present disclosure may provide several advantages over prior techniques. By automatically performing document alignment, time-consuming and error-prone manual alignment processing may be avoided, leading to cost savings. Further, by avoiding feed and jam errors during processing, more documents can be processed leading to greater efficiency. Manual intervention to address such errors may also become less frequent, leading to even greater cost savings. Also, the compact alignment module and roller designs described herein may allow the present techniques to be incorporate into document processing systems without greatly increasing the footprint of those systems. Costs associated with having to rerun the document at a later time in the process may also be reduced or avoided. Monetary charges associated with rejected documents may also be avoided or reduced.

FIG. 1 is a block diagram illustrating an example system 100 for performing automatic document alignment. As shown, example system 100 includes a document processing system 102. The document processing system 102 includes a document alignment module 106, and the document processing module 110. The controller 108 is communicatively coupled to the document alignment module 106 and the document processing module 110. In operation, the document processing system 102 is presented with one or more documents 104. The document alignment module 106 aligns the documents 104 for the documents 104 mechanically fed to the document processing module 110. The document processing module 110 performs processing operations on the documents 104. In some implementations, the document processing module 110 may produce one or more products of its processing operations associated with the documents 104, such as, for example, one or more images 112 corresponding to the one or more documents 104.

In some cases, the documents 104 may include magnetic ink to be read by a magnetic head within the document processing module 110. The magnetic ink may encode, for example, an account number or other information related to the document. If a document 104 is not aligned correctly, the document processing module 110 may not be able to read the magnetic ink, leading to processing errors.

As shown, example system 100 includes a document processing system 102. In some implementations, the document processing system 102 may be automated system operable to receive the one or more documents 104, and physically move the documents 104 along a path to be processed by the document processing module 110. In some cases, the document processing system 102 may process each document of the one or more documents 104 individually, such that each document is moved along the path by itself. Such operation may allow the document processing module 110 to perform its processing operations on each document individually. The document processing system 102 may include mechanical components operable to move each of the one or more documents 104 along the path, such as, for example, rollers, belts, gears, stepper motors, or other components.

One or more documents 104 are introduced to the document processing system 102 for processing. In some cases, the one or more documents 104 may be tangible, physical paper documents, such as, for example, checks, currency, agreements, sales drafts, or other types of documents. The one or more documents 104 may be introduced to document processing system 102 in an unaligned state, such that the respective bottom edges of the one or more documents 104 are not aligned.

The document processing system 102 includes a document alignment module 106. In operation, the document alignment module 106 may be operable to align the bottom edges of the documents 104 with an alignment surface of the document processing system 102. In some cases, the alignment surface may be a bottom surface of a staging area adjacent to the document alignment module 106 into which the documents 104 are introduced. The document alignment module 106 may include one or more mechanical components operable to perform this alignment on the one or more documents 104. The mechanical components may include rollers, belts, stepper motors, gears, or other components. The document alignment module 106 is described in greater detail in relation to FIGS. 2-7.

Document processing system 102 also includes a document processing module 110. The document processing module 110 may be operable to receive the one or more documents 104 individually from the document alignment module 106 after the one or more documents 104 have been aligned by the document alignment module 106. The document processing module 110 may perform processing actions on each document as it is received from the document alignment module 106. The processing actions may include, but are not limited to, scanning each document to produce a corresponding image, physically altering each document (e.g., hole-punching, stamping, etc.), shredding each document, analyzing and routing each document, or other processing actions. The document processing module 110 may include one or more mechanical components operable to receive each of the one or more documents 104 for processing, and to eject each of one or more documents 104 after processing so a next document can be processed. Ejecting each document may include moving the document further along the path within the document processing system 100.

In some cases, the document processing module 110 may produce results corresponding to each document. For example, in a case where the document processing module 110 scans each of the documents 104, the document processing module 110 may produce one or more images 112 corresponding to the one or more documents 104. For example, the document processing system 102 may be a check scanning system, and the document processing module 110 may produce the one or more images 112 for use in an automated check clearing process. In some cases, the images 112 may be included within the containing file structure, such as, for example, a cash letter file.

The document processing system 102 also includes a controller 108. In operation, the controller 108 may control operations of the document alignment module 106 and the document processing module 110. In some cases, the controller 108 may direct mechanical components associated with the document alignment module 106 to perform alignment on the one or more documents 104. The controller 108 may direct mechanical components in response to an indication that the documents 104 had been introduced into the document processing system 102. In some cases, this indication may be provided by an optional sensor 107 included in a document staging area in the document processing system 102, and monitoring the document staging area for the presence of documents. The controller 108 may also direct the document processing module 110 to perform its processing operations after a document is fed to it. In some implementations, the controller 108 may include one or more processors. Each processor may be a central processing unit (CPU), an application specific integrated circuit (ASIC), a field-programmable gate array (FPGA), an embedded processor, or other type of processor. Optionally, the controller 108 may be coupled to a sensor 107 for detecting the presence of the documents 104 for processing.

Figure 2:
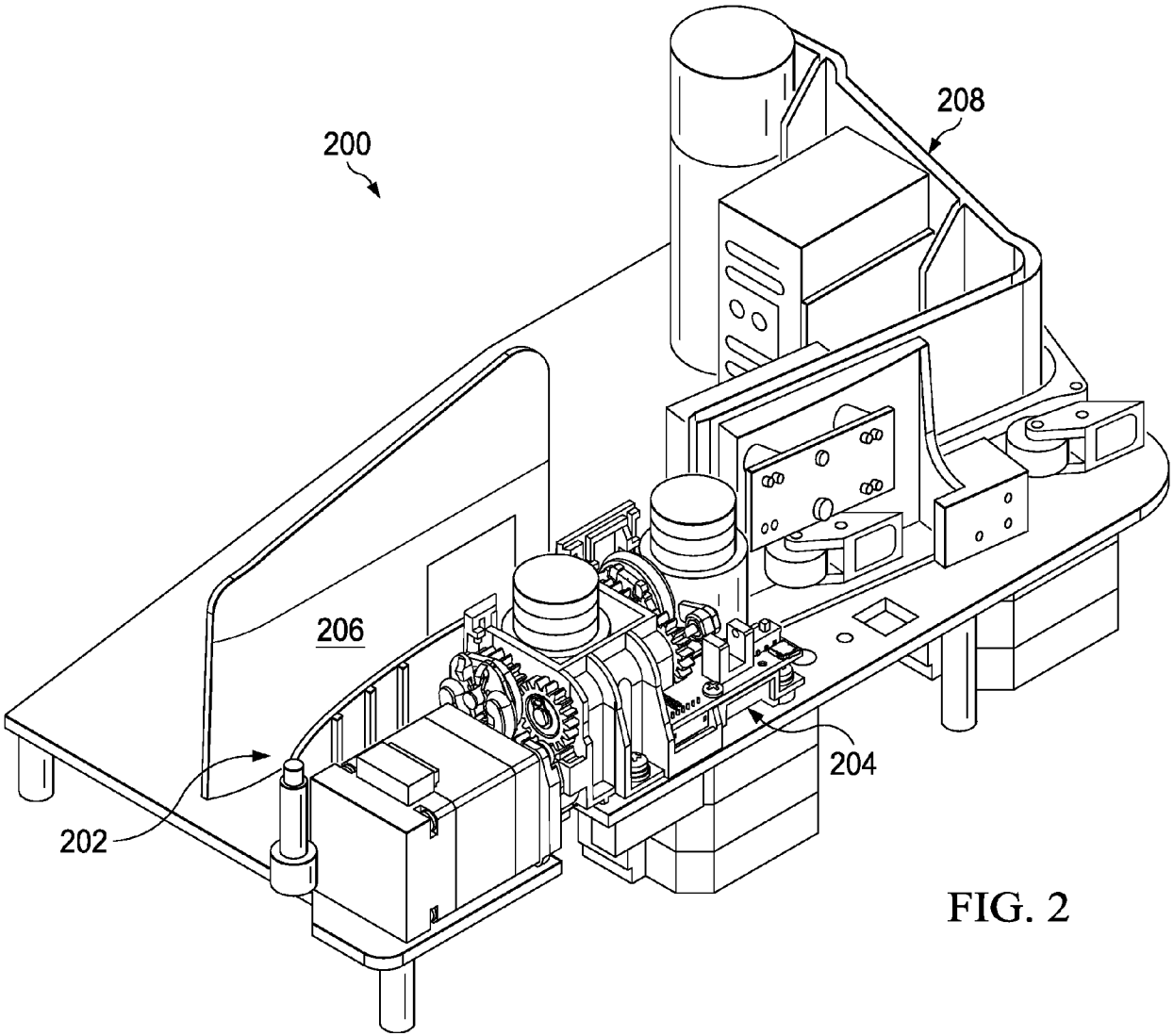
FIG. 2 is a perspective view of an example document scanning system that performs automatic document alignment.

FIG. 2 is a perspective view of an example document scanning system 200 that performs automatic document alignment. The document scanning system 200 includes a document staging area 202, a document alignment module 204, a spring-loaded mechanism 206, and a document scanning module 208. In operation, documents to be scanned or inserted into the document staging area 202. The spring-loaded mechanism 206 (e.g., a plunger) is actuated to press the documents in the document staging area 202 against the document alignment module 204. The document alignment module 204 operates to align the bottom edge of each document with a bottom surface of the document staging area 202. As described in greater detail below, the document alignment module 204 may include rollers that rotate to align the documents. The documents may be pressed against the rollers by the spring-loaded mechanism 206. After each document is aligned, the document is fed out of the document scanning system to document scanning module 208, where it is scanned and then ejected to make room for the next document. In some implementations, the document scanning system 200 may perform other processing operations on the documents, such as, for example, stamping, shredding, punching, or other operations. The components of the document scanning system 200 are described in greater detail below.

Figure 3A:
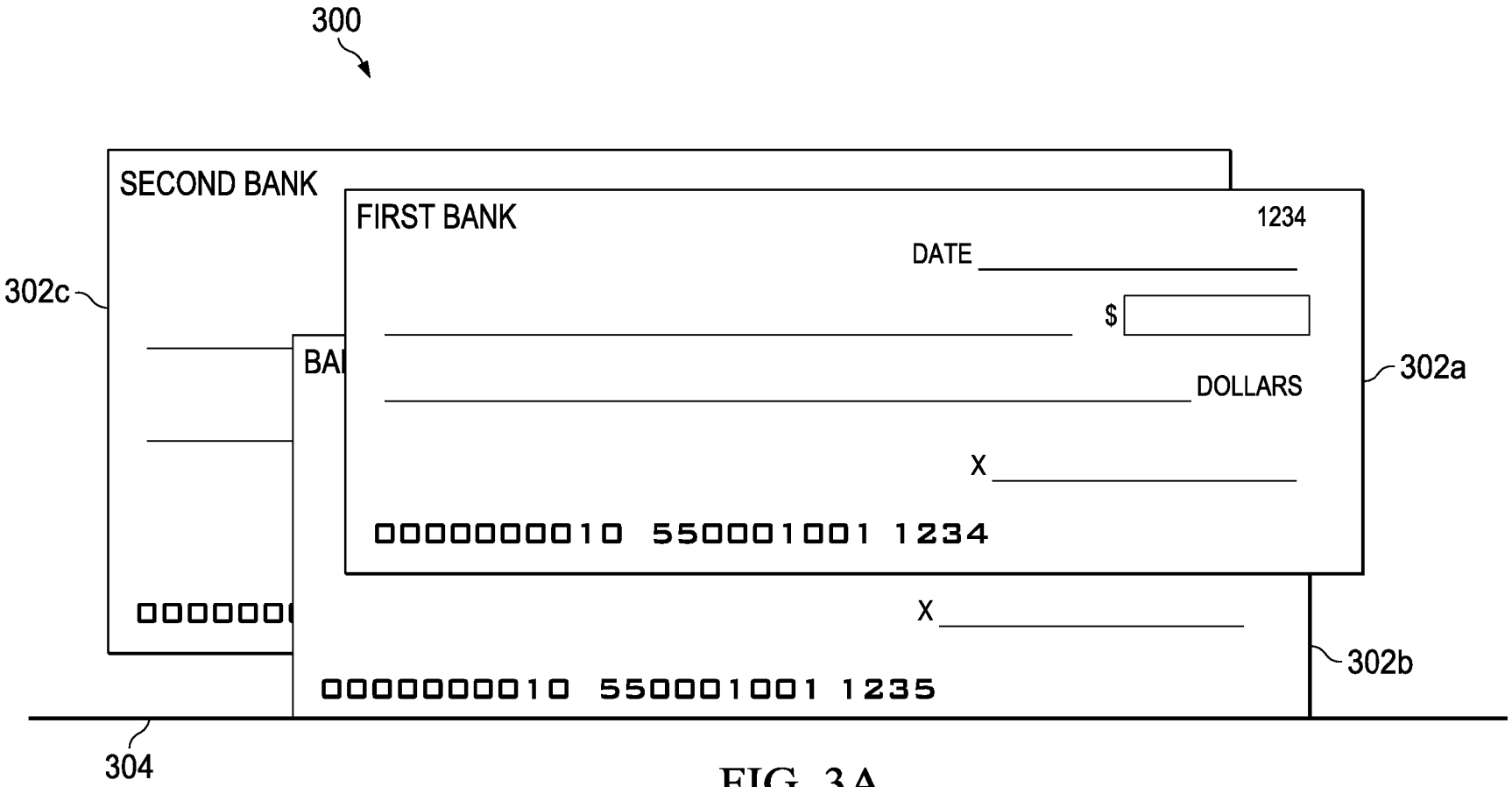
FIGS. 3A-B are diagrams illustrating example configurations including documents that are misaligned vertically.
Figure 3B:
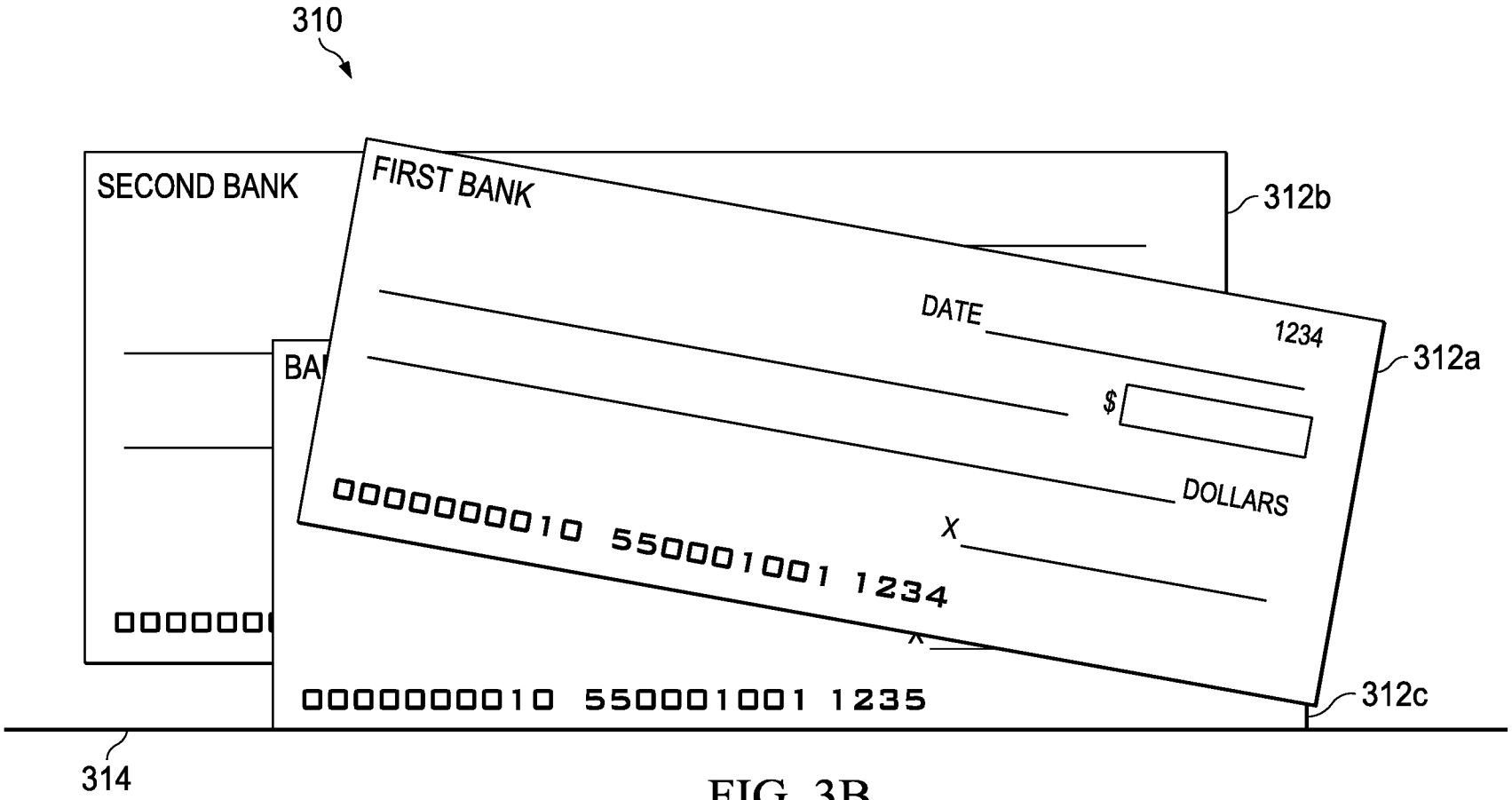

FIGS. 3A-B are diagrams illustrating example configurations 300, 310 including documents 302*a-c* and 304*a-c*, some of which are misaligned vertically. In FIG. 3A, documents

Figure 4:
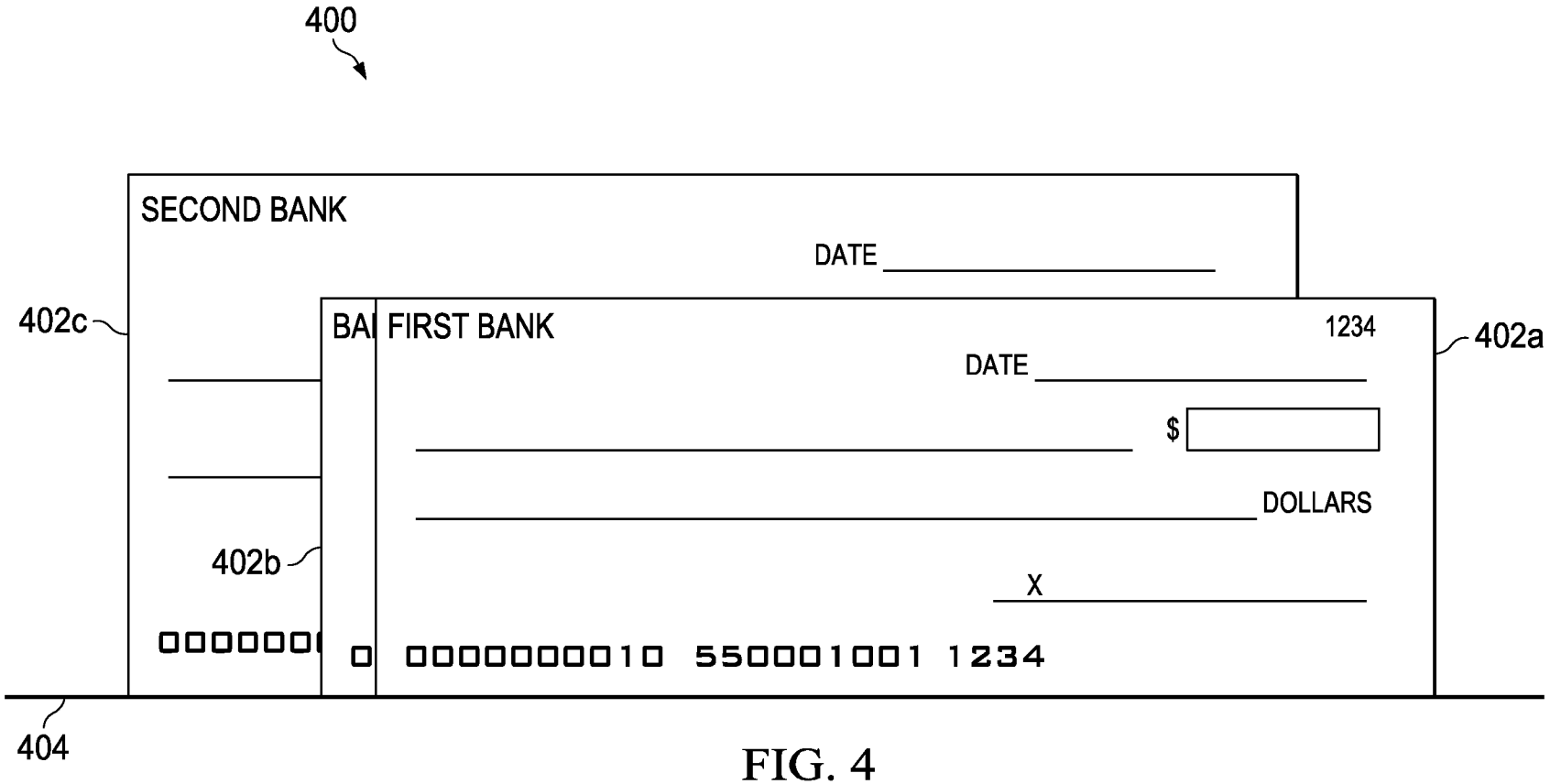
FIG. 4 is a diagram illustrating an example configuration including documents that are aligned vertically.

302*a* and *b* are misaligned with respect to an alignment surface 304. Document 302*b* abuts the alignment surface 304, and therefore is properly vertically aligned with respect to the alignment surface 304. As shown, the documents 302*a-c* include documents with different dimensions, as document 302*c* has different dimensions than the other two documents 302*a-b*. Although the documents 302*a-c* are shown as checks and FIG. 3A, documents 302*a-c* may include any kind of tangible physical document. FIG. 3B shows three documents 312*a-c* that are also misaligned with respect to an alignment surface 314. Document 312*a* is also skewed with respect to documents 312*b-c*. FIG. 4 is a diagram illustrating an example configuration 400 including documents 402*a-c* that are vertically aligned with an alignment surface 404. As shown, the bottom edges of the documents 402*a-c* abut the alignment service 404. Although FIG. 4 shows the documents 402*a-c* vertically aligned against the alignment service 404, the present disclosure contemplates aligning documents in any direction or combination of directions.

Figure 5:
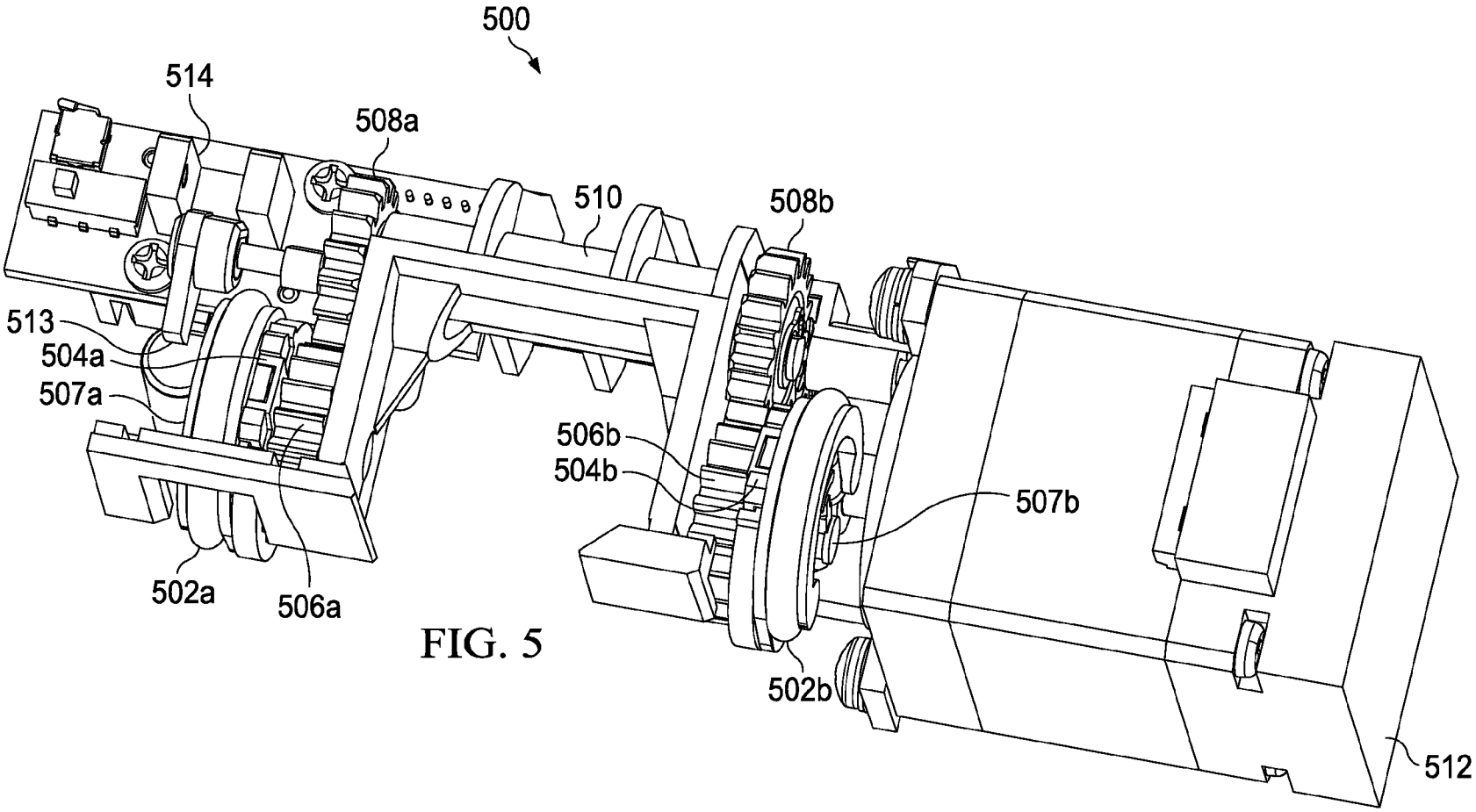
FIG. 5 is a perspective view of an example document alignment module.

FIG. 5 is a perspective view of an example document alignment module 500. Document alignment module 500 includes alignment rollers 502*a-b*. The alignment rollers 502*a-b* are attached to roller gears 506*a-b* by snap mounts 504*a-b*. The roller gears 506*a-b* are mounted on axles 507*a-b* and engage with drive gears 508*a-b*. The drive gears 508*a-b* are connected to a sync shaft 510. The sync shaft 510 is connected to a motor 512. In operation, the motor 512 rotates the sync shaft causing the drive gears 508*a-b* to rotate. The drive gears 508*a-b* engage the roller gears 506*a-b* to rotate the attached alignment rollers 502*a-b*.

Figure 6A:
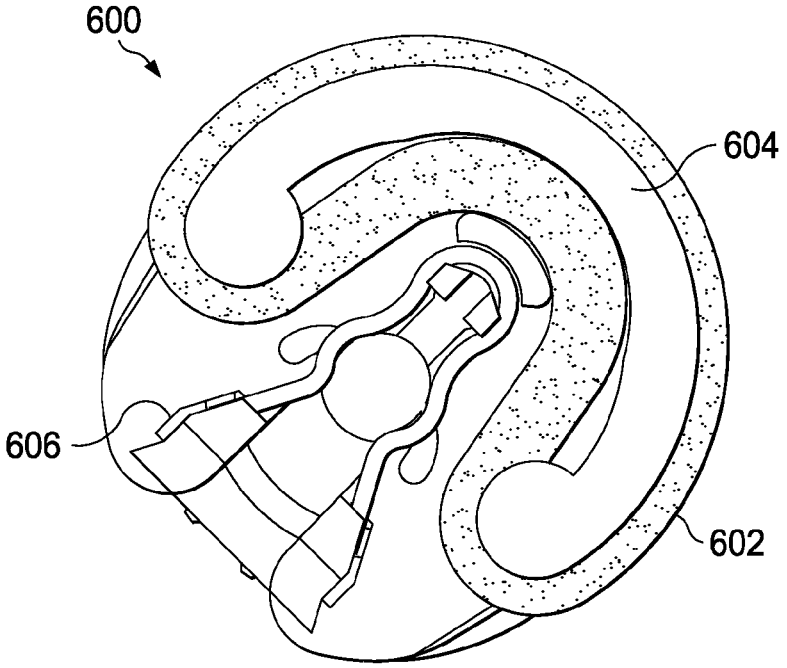
FIG. 6A is a side view of an example roller for use in a document alignment module.
Figure 6B:
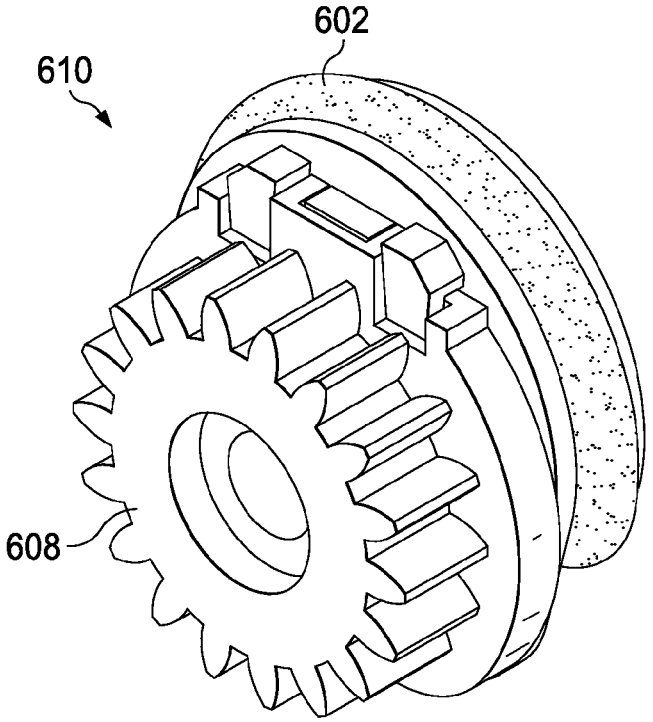
FIG. 6B is a perspective view of the example roller from an opposite side.

The document alignment module 500 includes the alignment rollers 502*a-b*. Although to alignment rollers 502*a-b* are shown in FIG. 5, some implementations may include a single alignment roller or more than two alignment rollers. In some cases, each alignment roller 502*a-b* includes contacting surface and a non-document contacting surface on its perimeter such that the distance from the axles 507*a-b* to the document contacting surface is equal to the distance from the axle to an adjacent document staging area (not shown). In such a case, the distance from the axle to the non-document contacting surface is less than that the distance from the axle to the document staging area, such that the document contacting surface intermittently engages a document in the document staging area when the alignment roller rotates to move the document. One example of such an implementation is shown in FIGS. 6A and 6B. In some cases, the document alignment module 500 may include mechanism to extend and retract the alignment rollers 502*a-b* into a document staging area positioned adjacent to the document alignment module 500.

As described previously, the roller gears 506*a-b*, engage with the drive gears 508*a-b*, and rotate as the sync shaft 510 is rotated by the motor 512. In some cases, the document alignment module 500 may include other mechanisms to rotate the alignment rollers 502*a-b*, such as, for example, belts, cams, axles, shafts, or other mechanisms.

The document alignment module 500 includes the motor 512. In some cases, the motor 512 may be electrical motor operable to rotate the sync shaft 510. In some cases, the motor 512 may be controllable by an external controller or processor. The motor 512 may also be a stepper motor.

The document alignment module 500 also includes a position flag 513 and an optical sensor 514. The position flag 513 rotates with the sync shaft to indicate the position of the alignment rollers 502*a-b*. The optical sensor 514 may detect the position of the position flag 513 and signal to other components (such as a controller) when the alignment rollers 502*a-b* have completed rotation and returned to their original starting point.

FIGS. 6A-B are opposite side views of an example alignment roller 600 for use in a document alignment module. The alignment roller 600 includes an O-ring 602, a curved O-ring post 604, and mounting clip 606. The opposite view in FIG. 6B shows a roller gear 608 formed on the opposite side of the alignment roller 600 from the mounting clip 606. As shown, the O-ring 602 extends outward from a portion of the perimeter of the alignment roller 600. The alignment roller 600 may be configured to rotate such that the O-ring 602 extends outward into space further than the remainder of the perimeter of the alignment roller 600. For example, if a document is positioned such that is in contact with the O-ring 602, the O-ring will only contact the document during a portion of a full rotation of the alignment roller 600.

As shown, the curved O-ring post 604 extends around a portion of the perimeter of the alignment roller 600. The curved O-ring post 604 is designed to provide the desired shape to the O-ring 602. In some cases, the O-ring 602 may be stretched to fit around the curved O-ring post 604 and held in place by tension.

In some implementations, the O-ring 602 may formed from a material selected to provide an amount of friction between the O-ring and a contacted document to cause the O-ring to stop moving the document once the document abuts an alignment surface. In some cases, the O-ring 602 may be formed from silicon, rubber, plastic, or other materials or combinations of materials.

As shown, the alignment roller 600 includes a mounting clip 606. In some cases, the mounting clip 606 may be operable to connect the alignment roller 600 to the roller gear 608, which may be mounted within a document alignment module, and to allow the alignment roller 600 to be removed and serviced or replaced.

FIGS. 7A-E are cross-sectional views of an example document alignment module 700 showing its operation. As shown, the example document alignment module 700 includes a plunger 704 operable to press a document 702 within a document staging area 703 into a position where it can be contacted by an alignment roller 706. The alignment roller 706 is connected to an axle 710. Alignment roller 706 includes an O-ring 708 extending along a portion of its perimeter. As shown, the O-ring 708 extends a greater distance from the axle 710 than the remaining portion of the perimeter of the alignment roller 706. A feed roller 712 is operable to rotate in a different direction than the alignment roller 706 to feed the document 702 out of the document staging area 703.

Figure 7A:
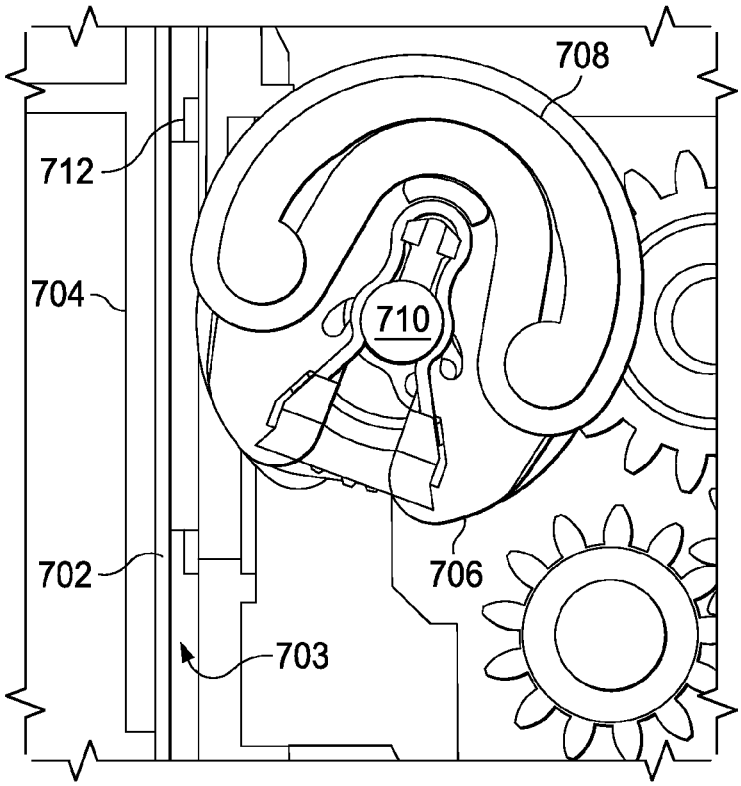
FIGS. 7A-E are cross-sectional views of an example document scanning system showing the operation of an example document alignment module.
Figure 7B:
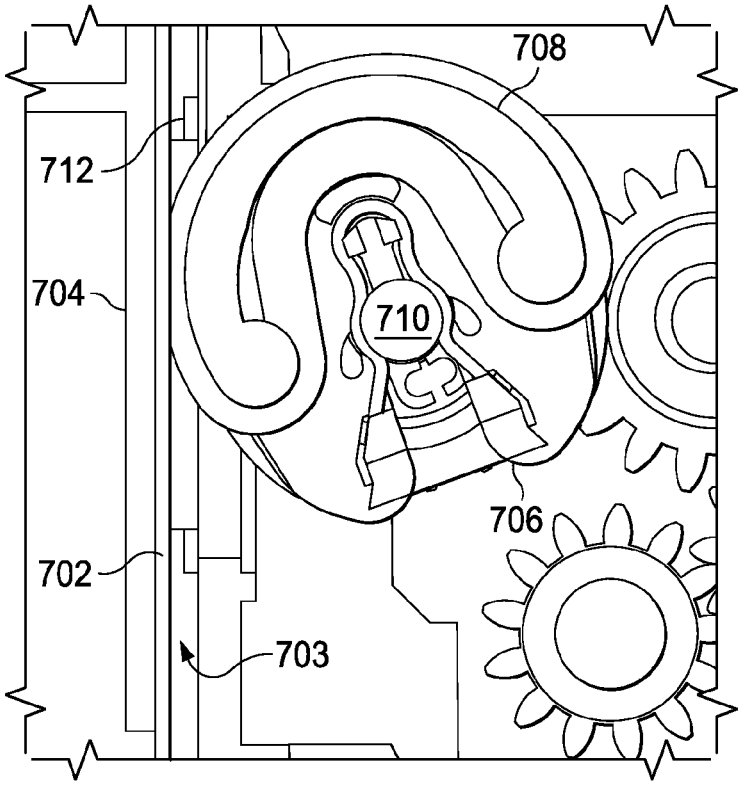
Figure 7C:
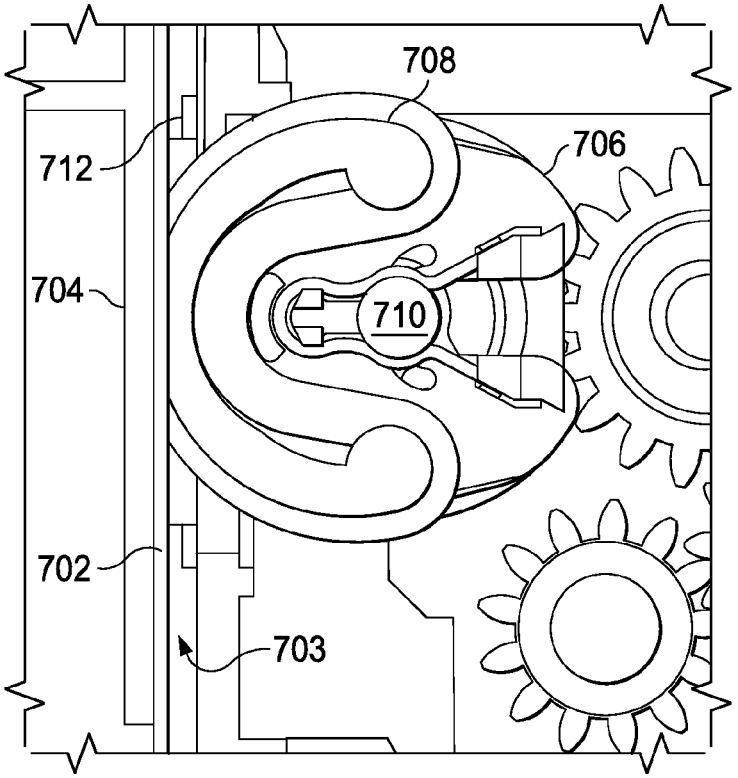
Figure 7D:
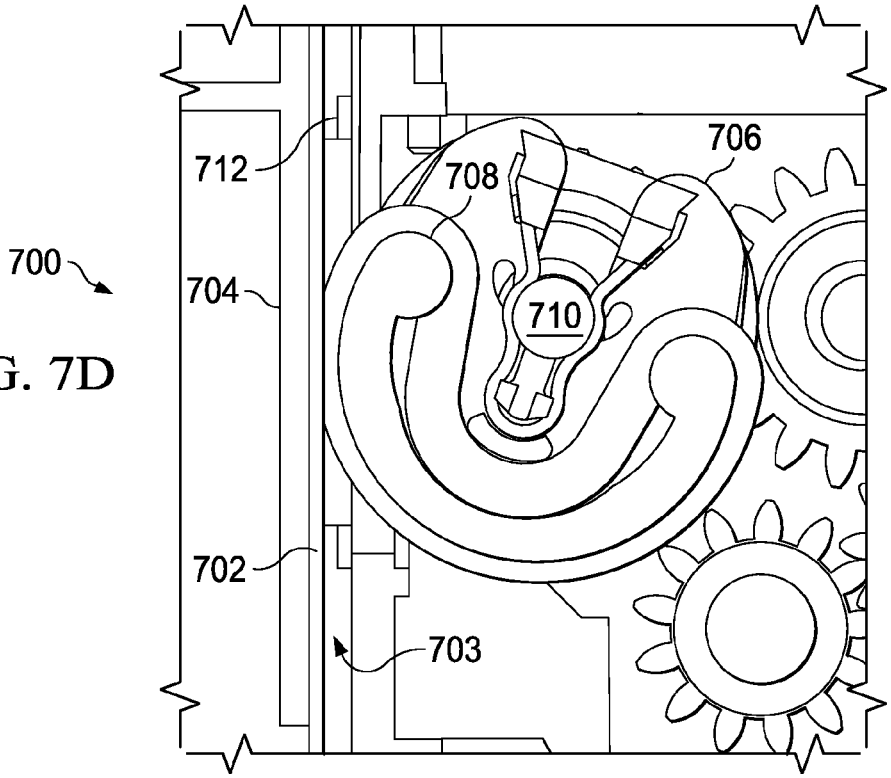
Figure 7E:
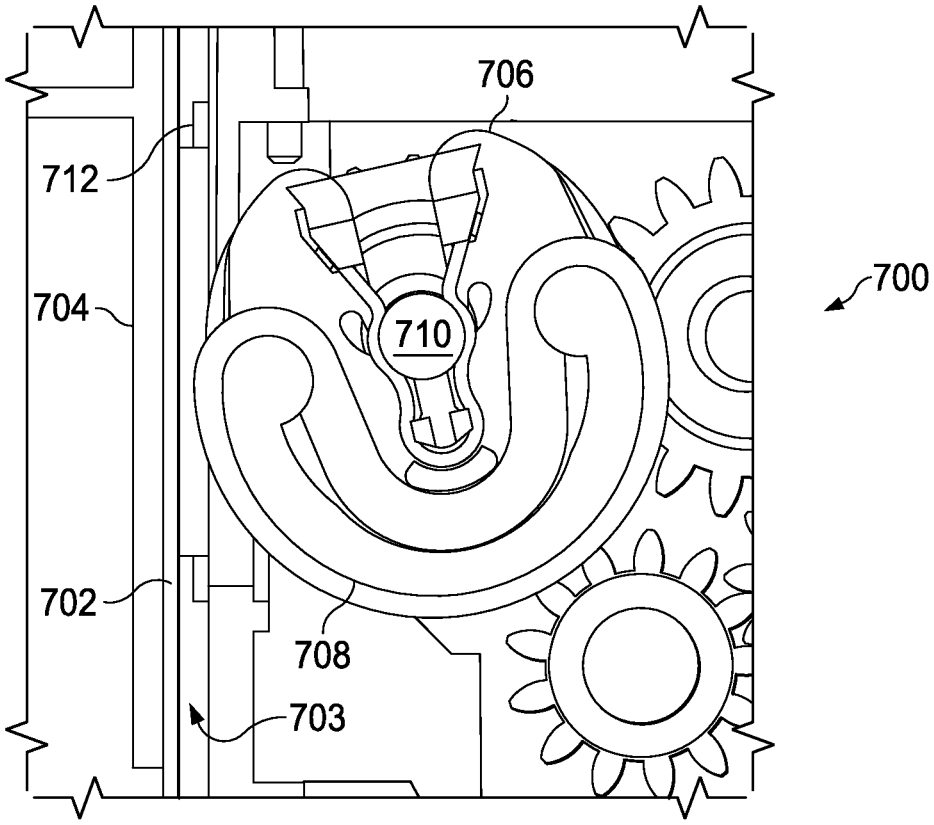

In FIG. 7A, the alignment roller 706 is positioned such that the O-ring 708 is not contacting the document 702. In FIG. 7B, the alignment roller 706 has been rotated into a position in contact with the document 702. In FIG. 7C, the alignment roller 706 has rotated further while the O-ring 708 has maintained contact with the document 702. This rotation of the alignment roller 706 causes the document 702 to be moved in the direction of the rotation (e.g., downwards) due to friction between the O-ring 708 and a document 702. In FIG. 7D, the alignment roller 706 has rotated further while the O-ring 708 maintains contact with the document 702. This rotation of the alignment roller 706 may cause the document 702 to move further in the direction of the rotation. If the document 702 abuts alignment surface (not shown) while the alignment roller 706 is rotating and the O-ring 708 is still in contact with the document 702, the movement of the document 702 in the direction of rotation will be stopped by the alignment surface due to the friction characteristics of the O-ring 708 previously described above. In FIG. 7D, the alignment roller 706 has rotated such that the O-ring 708 is no longer in contact with the document 702. At this point, the feed roller 712 may be engaged to move the document 702 out of the document staging area 703.

In some implementations, the activation of the feed roller 712 may be controlled by a controller connected to the feed roller 712 and the alignment roller 706. For example, the controller may determine the position of the alignment roller 706, and may activate the feed roller 712 when the alignment roller 706 reaches a position where the O-ring 708 is no longer in contact with the document 702. In some cases, the controller may determine the position of the alignment roller 706 by interfacing with a sensor configured to monitor the position. The controller may also determine the position of the alignment roller 706 based on control commands is set to a stepper motor controlling the rotation of the alignment roller 706.

In some cases, the O-ring 708 may be replaced by a structure besides an O-ring that has a friction coefficient appropriate to align the documents without causing damage to the documents.

Figure 8:
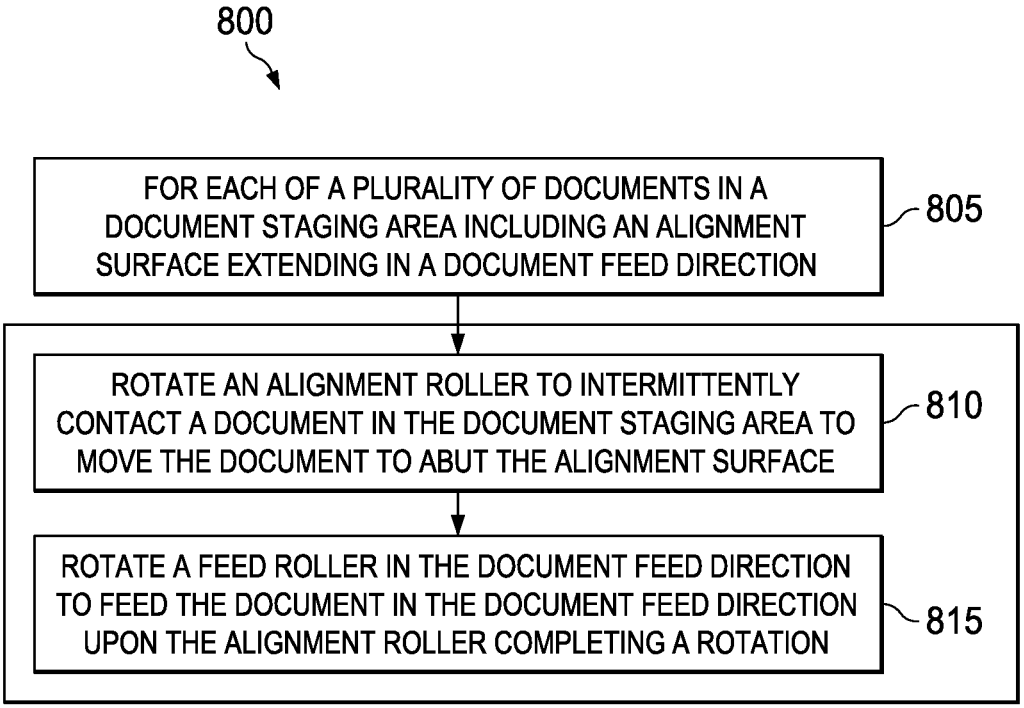
FIG. 8 is flow chart showing an example method for performing automatic document alignment.

FIG. 8 is flow chart showing an example method 800 for performing automatic document alignment. At 805, the process iterates through a plurality of documents in the document staging area including alignment surface extending in a document feed direction. At each iteration, an alignment roller is rotated to intermittently contact a document in the document staging area to move the documents about the alignment surface (810). The alignment roller may include an O-ring configured to extend along a portion of an outside surface of the alignment roller that contacts the document. In some cases, the O-ring includes a material selected to provide an amount of friction between the O-ring and the document to cause the O-ring to stop moving the document once the document abuts the alignment surface. In some implementations, the alignment roller is shaped to extend into the document staging area when it is rotated. At 815, a feed roller is rotated in the document feed direction to feed the document out of the document staging area upon the alignment roller completing a rotation.

In some implementations, the method 800 includes scanning the document to produce a digital image of the document after rotating a feed roller to feed the document. In some cases, the plurality of documents may include a tangible payment instruments such as checks, deposit slips, money orders, or other tangible payment instruments.

In some implementations, a position sensor detects the position of the alignment roller to determine when the alignment roller has returned to its initial starting position. In some cases, the sensor may also monitor the alignment roller's position as it rotates through the incorporation of an encoder wheel. In some cases, a spring-loaded force such as a plunger is activated to provide pressure on the document to force it to contact the alignment roller as it is rotating and further provide relief for the encoder wheel.

While this specification contains many details, these should not be construed as limitations on the scope of what may be claimed, but rather as descriptions of features specific to particular examples. Certain features that are described in this specification in the context of separate implementations can also be combined. Conversely, various features that are described in the context of a single implementation can also be implemented in multiple embodiments separately or in any suitable subcombination. A number of embodiments have been described. Nevertheless, it will be understood that various modifications can be made. Accordingly, other embodiments are within the scope of the following claims.

What is claimed is:

1. A system comprising:

a document staging area including an alignment surface extending in a document feed direction;

an alignment roller supported to rotate about an axis and intermittently contact a document in the document staging area while rotating to move the document to abut the alignment surface, wherein the alignment roller includes a rubber surface extending along a portion of an outside surface of the alignment roller that contacts the document when the alignment roller rotates, and wherein the rubber surface includes a material selected to provide an amount of friction between the rubber surface and the document to cause the rubber surface to stop moving the document once the document abuts the alignment surface; and a feed roller supported to rotate in the document feed direction to feed the document in the document feed direction after the alignment roller has rotated to move the document to abut the alignment surface.

2. The system of claim 1, wherein the rubber surface of the alignment roller includes an O-ring.

3. The system of claim 2, wherein the O-ring traverses the alignment roller.

4. The system of claim 1, wherein the alignment roller is non-circular with a circular portion shaped to extend into the document staging area when the alignment roller is rotated.

5. The system of claim 1, further comprising a controller connected to the alignment roller and the feed roller and configured to control operations of the alignment roller and the feed roller in response to receiving an indication from a sensor in the document staging area that the document has been introduced into the document staging area.

6. The system of claim 1, further comprising a document scanner configured to receive the document from the feed roller and scan the document to produce a digital image of the document.

7. The system of claim 1, further comprising a spring loaded plunger positioned in the document staging area and configured to hold the document in contact with the alignment roller as it is intermittently contacting the document.

8. A system comprising:

an alignment roller supported to rotate about an axis and intermittently contact a document in the document staging area while rotating to move a document in an adjacent document staging area to abut an alignment surface of the document staging area extending in a document feed direction, wherein the alignment roller includes a rubber surface extending along a portion of an outside surface of the alignment roller that contacts the document when the alignment roller rotates, and wherein the rubber surface includes a material selected to provide an amount of friction between the rubber surface and the document to cause the rubber surface to stop moving the document once the document abuts the alignment surface.

9. The system of claim 8, further comprising an axle positioned adjacent to the document staging area, wherein the alignment roller is supported by the axle and the alignment roller includes a document contacting surface and a document non-contacting surface on its perimeter, wherein the distance from the axle to the document contacting surface of the alignment roller is equal to the distance from the axle to the document staging area, the distance from the axle to the document non-contacting surface of the alignment roller is equal to the distance from the axle to the document staging area, and the alignment roller is positioned so that the document contacting surface intermittently engages the document in the document staging area when the alignment roller rotates to move the document to abut the alignment surface.

10. The system of claim 8, wherein the rubber surface of the alignment roller includes an O-ring.

11. The system of claim 10, wherein the O-ring does not extend along the entire outer surface of the alignment roller.

12. The system of claim 9, further comprising a feed roller to feed document in the document feed direction after the alignment roller completes a rotation.

13. The system of claim 12, further comprising a document scanner configured to receive the document from the feed roller and scan the document to produce a digital image of the document.

14. The system of claim 13, further comprising a controller connected to the alignment roller and the feed roller and configured to control operations of the alignment roller and the feed roller.

15. The system of claim 13, further comprising a plunger positioned in the document staging area and configured to hold the document in contact with the alignment roller as it is intermittently contacting the document.

16. A method comprising:

for each of a plurality of documents in a document staging area, the document staging area including an alignment surface extending in a document feed direction:

rotating an alignment roller to intermittently contact a document in the document staging area to move the document to abut the alignment surface, wherein the alignment roller includes a rubber surface extending along a portion of an outside surface of the alignment roller that contacts the document when the alignment roller rotates, and wherein the rubber surface includes a material selected to provide an amount of friction between the rubber surface and the document to cause the rubber surface to stop moving the document once the document abuts the alignment surface; and rotating a feed roller in the document feed direction to feed the document in the document feed direction upon the alignment roller completing a rotation.

17. The method of claim 16, wherein the rubber surface of the alignment roller includes an O-ring.

18. The method of claim 16, further comprising actuating a plunger to force a document from the plurality of documents into contact with the alignment roller before rotating the alignment roller.

* * * * *

UNITED STATES PATENT AND TRADEMARK OFFICE

CERTIFICATE OF CORRECTION

PATENT NO. : 9,114,942 B1
APPLICATION NO. : 14/318335
DATED : August 25, 2015
INVENTOR(S) : Ronald Fahilga, Glenn Embury and Christian Chu It is certified that error appears in the above-identified patent and that said Letters Patent is hereby corrected as shown below:

In the Claims

Column 9, Line 10, In Claim 12, delete "claim 9," and insert -- claim 8, --, therefor.

Signed and Sealed this
Nineteenth Day of April, 2016

Michelle K. Lee

Michelle K. Lee
*Director of the United States Patent and Trademark Office*